US005992472A

United States Patent [19]

Maroino

[11] Patent Number: 5,992,472

[45] Date of Patent: Nov. 30, 1999

[54] PNEUMATIC VALVE DEVICE FOR A THREAD-FEEDING MACHINE AND A THREAD-FEEDING MACHINE

[75] Inventor: Adriano Maroino, Cossato, Italy

[73] Assignee: IRO AB, Ulricehamn, Sweden

[21] Appl. No.: 09/029,800

[22] PCT Filed: Sep. 4, 1996

[86] PCT No.: PCT/EP96/03882

§ 371 Date: Jun. 15, 1998

§ 102(e) Date: Jun. 15, 1998

[87] PCT Pub. No.: WO97/10458

PCT Pub. Date: Mar. 20, 1997

[30] Foreign Application Priority Data

Sep. 11, 1995 [DE] Germany ..... 195 33 547

[51] Int. Cl.[6] ..... F16K 11/20

[52] U.S. Cl. ..... 139/452; 139/435.4; 137/329.3; 137/637; 137/614.05; 226/97; 239/589; 28/272

[58] Field of Search ..... 239/DIG. 19, 61, 239/62, 587.3, 587.4, 589; 139/435.4, 452; 137/329.3, 637, 861, 614.05, 614.04; 226/97; 251/155, 251, 301; 28/272, 273

[56] References Cited

U.S. PATENT DOCUMENTS

| | | | |
|---|---|---|---|
| 4,951,915 | 8/1990 | Piao | 251/251 |
| 5,094,275 | 3/1992 | Shaw et al. . | |
| 5,111,852 | 5/1992 | Verhulst | 139/435.4 |
| 5,181,544 | 1/1993 | Deiuri . | |
| 5,191,680 | 3/1993 | Kaneko et al. | 28/272 |
| 5,351,724 | 10/1994 | Zenoi et al. | 139/452 |
| 5,462,095 | 10/1995 | Okesaku | 139/435.4 |

FOREIGN PATENT DOCUMENTS

| | | |
|---|---|---|
| 0 418 948 A1 | 3/1991 | European Pat. Off. . |
| 0 567 045 A1 | 10/1993 | European Pat. Off. . |
| 44 12 863 C1 | 4/1994 | Germany . |
| WO 92/22693 | 12/1992 | WIPO . |

*Primary Examiner*—Andy Falik

*Attorney, Agent, or Firm*—Flynn, Thiel, Boutell & Tanis, P.C.

[57] ABSTRACT

A pneumatic valve device for a yarn feeding device includes a housing, at least two valves in flow channels leading to a plurality of consumers, and first and second valve openers. The first valve opener establishes a connection with at least one consumer, whereas the second valve opener can establish a connection with all of the consumers. Flow channels are provided which are separated from one another and lead to the at least one consumer and to the remaining consumers, and a unilaterally operating drag coupling is also provided between the second valve opener and the valve that is actuated by the first valve opener. The actuating movement of the second valve opener is also transferable to the valve by means of the unilaterally operating drag coupling. In the yarn feeding device, a first threading nozzle or the first and at least a second threading nozzle are selectively pressurized by means of the valve device, optionally together with a pneumatic piston-cylinder unit.

17 Claims, 3 Drawing Sheets

PNEUMATIC VALVE DEVICE FOR A THREAD-FEEDING MACHINE AND A THREAD-FEEDING MACHINE

FIELD OF THE INVENTION

The present invention relates to a pneumatic valve device and a yarn feeding device having the valve device wherein valves are provided to control consumers such as yarn threading nozzles.

BACKGROUND OF THE RELATED ART

In a yarn feeding device which is known from WO 92/22693 (U.S. Pat. No. 5,094,275), a pneumatic valve device which consists either of a main switching valve with inhibiting valves arranged downstream thereof, or of a multi-position multi-way valve or of a rotary slide valve, serves to selectively actuate either only one yarn threading nozzle provided at the feed side or to actuate a plurality of yarn feeding nozzles with compressed air.

In a yarn feeding device which is known from the brochure "Galaxy", reference number 48-1025-201/9239, of the company IRO AB, SE, page 15, issued in 1992, a pneumatic valve device is installed in the motor housing which can selectively be operated by means of two valve openers that are formed as externally accessible push buttons, namely in such a manner that either only the threading nozzle at the feed side is pressurized (by pressing the push button arranged on the back side of the motor housing) or all of the threading nozzles are pressurized (by pressing the push button arranged at the side of the motor housing). In these yarn feeding devices, which have been on the market since 1992, the valve device comprises a metal block in which two valves that are selectively actuable by means of the valve openers are contained in a chamber which is connected to a source of pressure and from which flow channels lead to the yarn threading nozzle at the feed side and to the other yam threading nozzles. In addition, a transverse connection is provided between the flow channels in the housing, the transverse connection containing a check valve which automatically opens in the flow direction towards the threading nozzle at the feed side, and automatically shuts off in the opposite flow direction. The valve device with the valve openers is composed of many parts and is technically troublesome with respect to manufacture and mounting.

In a yarn feeding device which is known from U.S. Pat. No. 5,181,544, a block which is connected to the motor housing has provided therein a compressed-air distributor which leads to a plurality of threading nozzles and to a pneumatic piston-cylinder unit and has arranged upstream thereof a valve which can be actuated by means of a valve opener. However, it is only possible to pressurize all of the consumers at the same time.

Finally, EP-A-0 418 949 discloses a valve device comprising a block-shaped housing and two valves, with two push buttons being provided for selectively connecting one of two outlets or both outlets to the source of pressure. To connect both outlets to the source of pressure, both push buttons must be pressed.

It is the object of the present invention to provide a valve device of the above-mentioned type and a yarn feeding device comprising such a valve device, in the case of which it is possible to choose between an individual actuation and the multiple actuation of consumers in a simple manner with respect to production and also in a user-friendly way.

SUMMARY OF THE INVENTION

This object is achieved according to the invention wherein a drag coupling is provided between a first valve opener of a first valve and a second valve opener opens said first valve and said second valve.

The valve device is simple from a constructional point of view because it just contains the two valves and the separated flow channels, so that a transverse connection with an additional check valve is not necessary. The valve device is particularly user-friendly because only the first or the second valve opener must be actuated to control either the pressurization of the at least one consumer or to control the pressurization of all consumers. The drag coupling is simple with respect to manufacture and reliable in function.

With simple constructional efforts, the yarn feeding device offers high operating convenience because it is only the one or the other valve opener which must be actuated for setting the respective functional mode.

In the embodiment wherein the drag coupling is provided between the first valve opener and a second valve opener of the second valve, the first valve opener is carried along upon actuation of the second valve opener in order to actuate also the valve which is assigned to the first valve opener.

In the embodiment wherein the drag coupling is provided between two actuating connections, the actuating connection which is not directly actuated via the valve opener is carried along via the drag coupling to open the other valve as well.

In the embodiment wherein the drag coupling is disposed between the actuating connection of the first valve opener and the second valve opener, the second valve opener acts in a constructionally simple manner via the drag coupling on the actuating connection of the other valve seat.

A constructionally very simple embodiment is provided wherein the two valve openers positively overlap in a direction transverse to their actuating directions.

The embodiment wherein one of the two valve openers includes a catch which engages the other valve opener is technically simple with respect to manufacture and reliable in function.

In the embodiment wherein the valve openers are flip switches or push buttons, large contact surfaces can be created for the fingers. Furthermore, these valve openers can be arranged in a constructionally simple manner and such that they can clearly be felt or are clearly visible.

A particularly expedient embodiment is provided when the housing is formed from two parts. The two housing parts can easily be controlled with respect to their shapes even if all constructional parameters for the desired functions are integrated. The housing is compact, especially when wherein the two valve openers are secured with the catch to a housing part it consists of injection-molded parts of plastics which are characterized by dimensional accuracy and small weight with adequate dimensional stability.

The embodiment according to claim 10 is technically simple with respect to manufacture.

However, it may particularly be expedient, when the valve openers are integrally formed with the housing part, with the number of the parts to be mounted being as small as possible.

Providing the valve openers with surface structures that clearly differ from one another when being touched is especially important. Thanks to this feature one can feel with the tip of one's finger which valve opener is actuated without having a closer look thereat. Moreover, the two valve openers may be provided with different colors to permit already an optical distinction. If necessary, they are even labeled with respect to the function to be performed by them.

In the embodiment of the yarn feeding device wherein an extension arm includes an annular brake body which cooperates with the storage body, the brake body can be brought into the gap position by operating the second valve opener, even if the threading nozzles are pressurized, namely expediently in advance thereof.

The embodiment wherein the valve device is a plastic housing which is inserted into a cutout of the motor housing facilitates mounting. The valve device can advantageously be integrated into the motor housing, it saves part of the motor housing and fills the cutout expediently completely.

In the embodiment wherein a compressed-air connection is connected to a supply connection by an elastic connection tube the connection of the valve device is given an especially simple design.

Finally, in the embodiment wherein locking tongues are provided, the valve device can easily be mounted. It has a stable seat in the motor housing. The locking tongues just constitute negligible efforts in the manufacture of housing parts and simplify assembly and disassembly.

BRIEF DESCRIPTION OF THE DRAWINGS

Embodiments of the subject matter of the invention will now be explained with reference to the drawings, in which.

DETAILED DESCRIPTION

Figure 1:
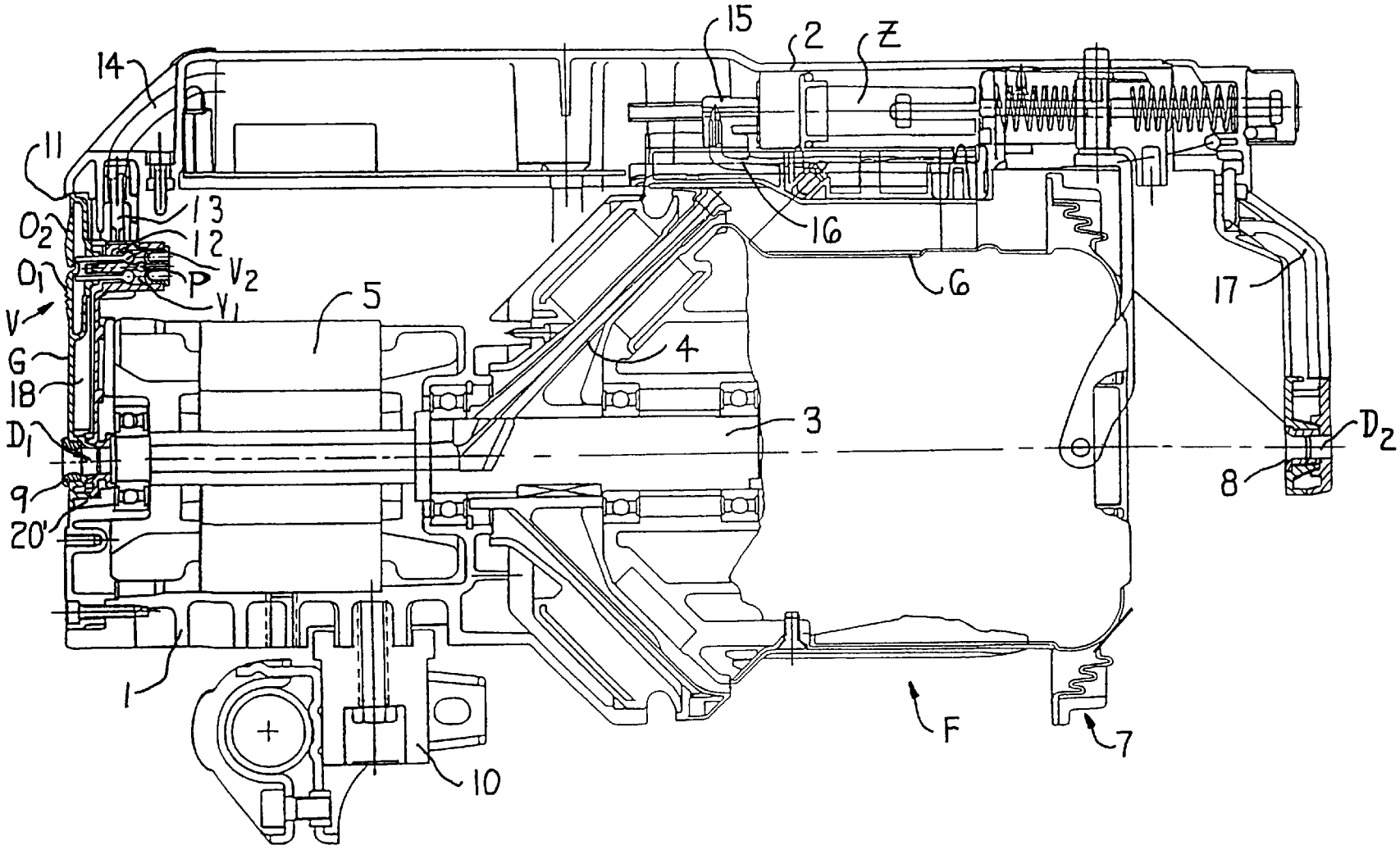
FIG. 1 is a diagrammatic longitudinal section through a yarn feeding device with a pneumatic valve device.

A yarn feeding device F according to FIG. 1 comprises a motor housing 1 which has secured thereto a longitudinally extending extension arm 2 and in which a hollow shaft 3 which carries a winding element 4 is supported in a rotatingly drivable manner by means of an electric motor 5. A storage drum 6 which is prevented in the conventional manner from rotating together with the hollow shaft 3 is rotatably supported on the hollow shaft 3. An annular yarn braking body 7 is supported on extension arm 2 in a longitudinally displaceable and adjustable manner, the yarn braking body 7 cooperating with the storage drum 6 in the customary manner. A withdrawal eyelet 8 is arranged at the end of extension arm 2 for the yarn which can be withdrawn overhead from the storage drum 6. Furthermore, an inlet eyelet 9 with an associated first threading nozzle D1 is provided in front of the feed end of the hollow shaft 3, and a second threading nozzle D2 is provided at the withdrawal eyelet 8. A pneumatic piston-cylinder unit Z which is accommodated in the extension arm 2 serves to adjust the yarn braking body 7 into a gap position (not shown) in which a passage gap is opened between the storage drum 6 and the yarn brake 7. The yarn feeding device F is fixed with amount 10 onto a support.

A cutout 11 which is provided in the rear side of the motor housing 1 accommodates a pneumatic valve device V which comprises a housing G, preferably made from molded parts of plastics, and optionally fills the recess 11 completely and is flush therewith. Two valves V1 and V2 which are, for instance, designed as ball check valves are provided in the valve device V between a pressure connection P and first and second flow channels 12 and 18, with the flow channel 12 being connected via a connection 13 and a pressure line 14 to a distributor 15 from which a passage leads into the piston-cylinder unit Z and further pressure lines 16, 17 lead to the second threading nozzle D2. By contrast, the flow channel 18 leads to the first threading nozzle D1. On its housing, the valve device V comprises first and second valve openers 01, 02 with the aid of which valves V1, V2 can be actuated. Furthermore, locking nozzles 20' on which housing G of valve device V is supported are molded into cutout 11.

Figure 2:
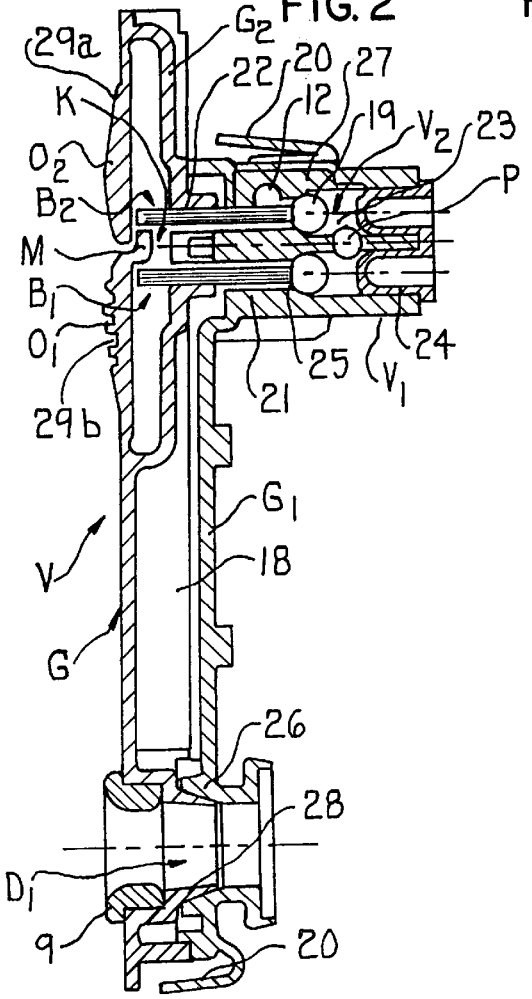
FIG. 2 shows a valve device, in section, as can be used in the yarn feeding device according to FIG. 1.
Figure 3:
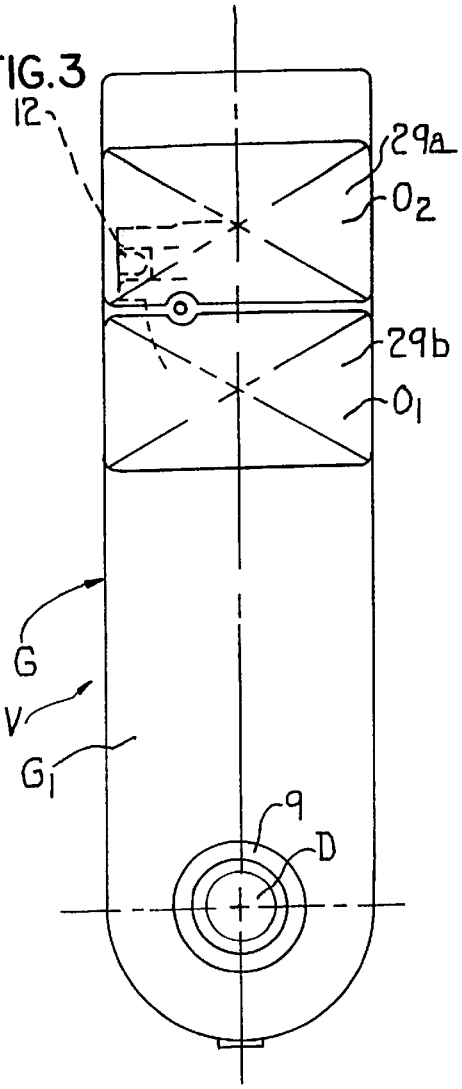
FIG. 3 is a front view of the valve device of FIG. 2.
Figure 5:
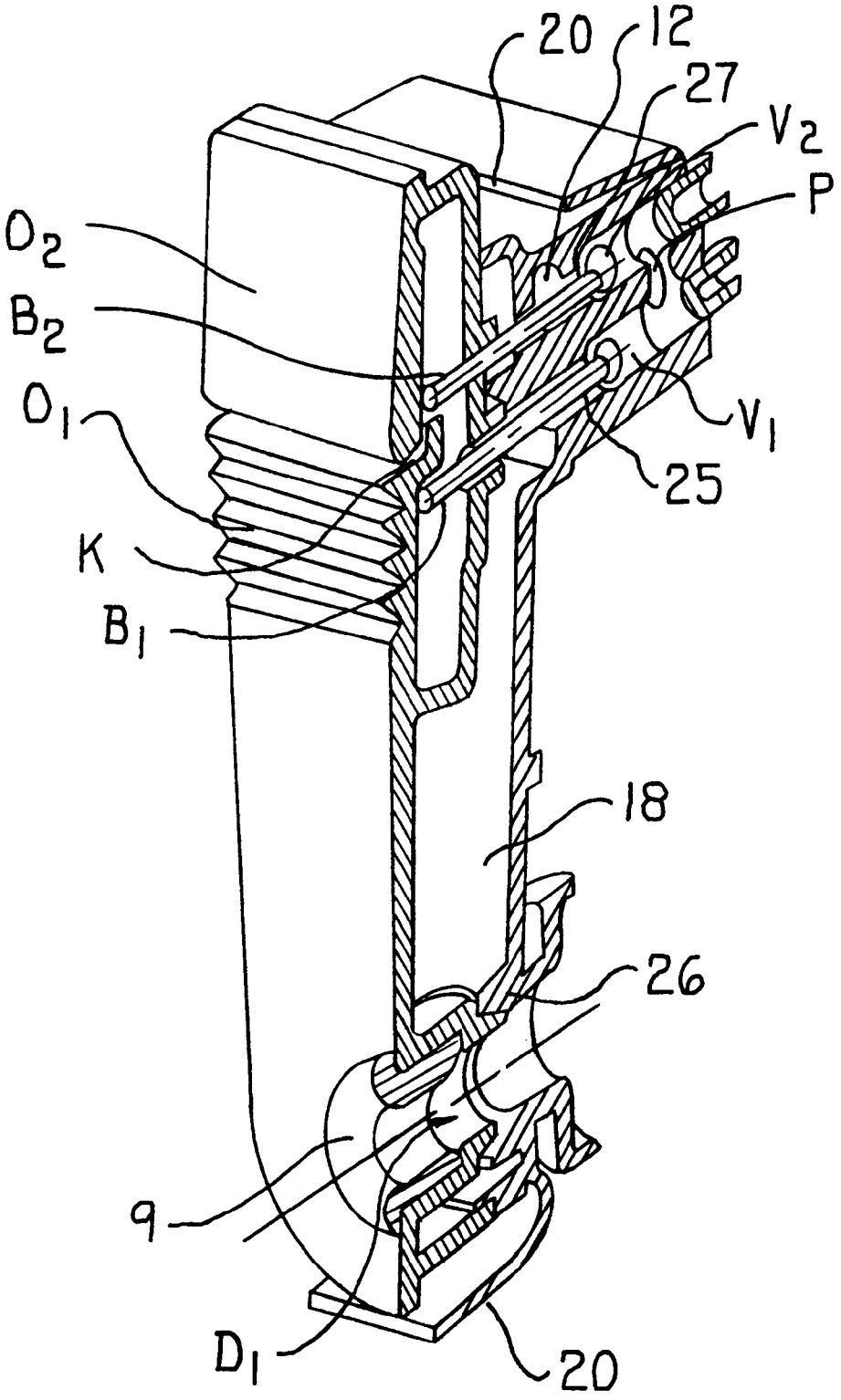
FIG. 5 is a perspective view of the valve device of FIG. 2.

FIGS. 2, 3 and 5 show the construction of the valve device V in detail. Housing G consists of two housing parts G1, G2, expediently injection-molded parts of plastics, which are firmly interconnected in a manner not shown in more detail. One housing part G1 accommodates a chamber 23 which is connected to the supply connection P and in which the closing elements of the two valves V1, V2, which are formed as balls 19, cooperate with valve seats 27. If necessary, balls 19 are actuated by closing springs (not shown) in the closing direction. Valve V1 monitors a connection of the chamber 23 to a first flow channel 25 which is continued along flow path 18 to the first threading nozzle D1. An actuating connection B1 which consists, for instance, of a valve plunger 21 which is slidable in a guide 22 and with the aid of which the ball 19 can be lifted from the valve seat is provided between the valve opener 01 (in this case a flip switch) assigned to the first valve V1, and the valve V1. An actuating connection B2 is also provided between the second valve opener O2 and the second valve V2 in the form of a valve plunger 21. The valve plunger 21 passes through the flow channel 12 which leads to the connection 13 which is laterally guided out of the housing part G1. The chamber 23 is hermetically sealed to the outside by a stopper 24. Furthermore, the housing part G1 has a transverse member which is formed as a nozzle element 26 in the free end thereof. Furthermore, locking tongues 20 which are intended for cooperation with the locking noses 20' (FIG. 1) and which can be used for holding and securing in position the valve device V in a yarn feeding device F of FIG. 1 are molded onto housing part G1.

The other housing part G2 comprises guide means 22 for the valve plunger 21, and a transverse member which together with the transverse member of housing part G1 defines the flow channel 18 leading to the first threading nozzle D1. A further nozzle element 28 which together with the nozzle element 26 forms an ejector nozzle as the first threading nozzle D1 is molded onto the end of the transverse member of housing G2. The yarn eyelet 9 is also inserted into the transverse member. Furthermore, the first and second valve openers 01, 02 are integrally formed into the housing part G2, namely in the form of flip switches having surface structures 29*a* and 29*b*, respectively, which can clearly be distinguished from one another. For instance, the surface structure 29*a* is smooth and convex or concavely curved, while the surface structure 29*b* is convex or concavely curved and provided with ribs, knobs, or similar raised portions which can be felt. Furthermore, there is provided a drag coupling K which is operative in the actuating direction of the second valve opener O2 and which upon actuation of valve V2 has the effect that the first valve V1 is actuated at the same time. The drag coupling K in FIG. 2 is formed as a catch M which is molded onto the first valve opener O1 and grips under the second valve opener O2. However, it would also be possible to provide the catch M on the second valve opener 02 on the outside such that it grips from the outside over the first valve opener O2.

This results in the following function:

When the first valve opener O1 is pressed, valve V1 is opened and a connection is established from the pressure connection P to the first threading nozzle D1. The second valve V2 remains closed. By contrast, when the second valve opener V2 is operated, the two valves V1 and V2 are opened. The compressed air flows to the first threading nozzle D1 and also to the at least one further second threading nozzle D2 and, if existing, also into the piston-cylinder unit Z. After the first or second valve opener 01, 02 has been released, the valves V1, V2 are automatically closed under the pressure prevailing in chamber 23.

Figure 4A:
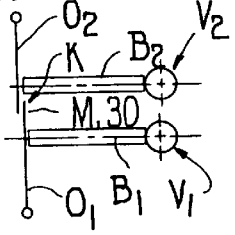
FIGS. 4*a–e* diagrammatically show alternate embodiments for the valve device.

FIG. 4*a* shows a design variant in which the second valve opener O2 overlaps the first valve opener O1 on the outside such that the edge 30 of the first valve opener 01 acts as a catch M.

Figure 4B:
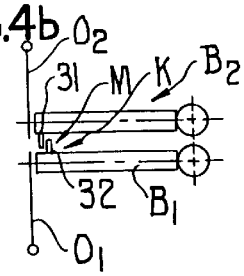

In the design variant of FIG. 4*b* the drag coupling K is provided between the two actuating connections B1, B2, namely in the form of stops 31, 32 which act as catches M, in case the second valve opener O2 is actuated.

Figure 4C:
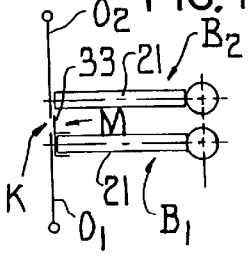

In the embodiment of FIG. 4*c*, a cap 33 which grips up to and below the second valve opener O2 and forms the catch M of the drag coupling K is arranged on the valve plunger 21 of the first actuating connection B1.

Figure 4D:
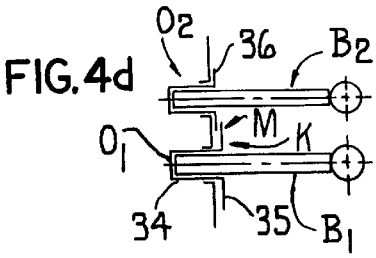

In the embodiment of FIG. 4*d*, the first and second valve openers O1, O3 are push buttons 34 which are linearly movable and the edges 36 and 35 of which overlap each other such that the edge 35 of the push button 34 forms the catch M of the drag coupling K.

Figure 4E:
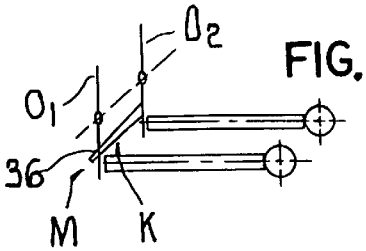

In the embodiment according to FIG. 4*e*, the first and second valve openers O1, O2 are toggle switches or rocker levers which are pivotable about an axis. The second valve opener O2 carries a transverse arm 36 which upon actuation of the second valve opener 02 carries along the first valve opener 01. The transverse arm 36 could also be mounted on the first valve opener 01 and grip behind the second valve opener O2 at the side facing the actuating connection.

I claim:

1. In a pneumatic valve device for a yarn feeding device, comprising a housing which contains a chamber that is connectable to a source of pressure, at least two valves arranged between said chamber and flow channels leading to a plurality of consumers, first and second valve openers which are each manually actuable and assigned to at least one of said valves, and actuating connections between each said valve opener and the at least one valve assigned thereto, the first valve opener establishing a connection from the chamber with at least one of said consumers, whereas the second valve opener can establish a connection from said chamber with all of said consumers, comprising the improvement wherein flow channels are provided which are separated from each other, said flow channels leading respectively from said chamber to the at least one consumer and to the remaining consumers, at least one of said valves being solely actuable by means of said first valve opener, and a unilaterally operating drag coupling being provided between said second valve opener and said valve which is solely actuable by means of said first valve opener, an actuating movement of said second valve opener being transmittable by means of said drag coupling also to said valve which is normally actuable by means of said first valve opener.

2. The valve device according to claim 1, wherein said drag coupling is provided between said first and second valve openers.

3. The valve device according to claim 1, wherein said drag coupling is provided between said two actuating connections.

4. The valve device according to claim 1, wherein said drag coupling is provided between said actuating connection of said first valve opener and said second valve opener.

5. The valve device according to claim 2, wherein said first and second valve openers positively overlap in a direction transverse to their actuating directions in such a manner that either said first valve opener grips below said second valve opener or said second valve opener grips over said first valve opener.

6. The valve device according to claim 2, wherein one of said two valve openers comprises a catch and said catch is arranged either on said first valve opener and grips below said second valve opener, or said catch is arranged on said second valve opener and grips over said first valve opener.

7. The valve device according to claim 1, wherein said first and second valve openers are adjacent flip switches or push buttons with approximately parallel actuating directions.

8. The valve device according to claim 1, wherein said housing is bipartite and includes housing parts, one said housing part comprising said chamber, a supply connection leading to said chamber, a first said flow channel leading from said chamber to a connection fixed onto the one housing part and to the remaining consumers, a second said flow channel leading from said chamber to a side surface of said housing part and to the at least one consumer, and a transverse member having a first nozzle element molded thereinto, the other said housing part comprising guides for valve plungers forming the actuating connections, said other housing part further comprising said first and second valve openers and a transverse member defining an extension of said second flow channel with the transverse member of said one housing part, said transverse member of said other housing part having molded thereinto a second nozzle element which together with said first nozzle element forms an ejector nozzle which is actuable from said second flow channel.

9. The valve device according to claim 8, wherein said housing parts are injection-molded parts of plastics.

10. The valve device according to claim 9, wherein said first and second valve openers are secured with a catch to said other housing part.

11. The valve device according to claim 9, wherein said first and second valve openers include a catch on one said valve opener, said valve openers being integrally formed with said other housing part and being approximately in alignment with the transverse member thereof.

12. The valve device according to claim 1, wherein said two valve openers have surface structures which clearly differ from one another when being touched.

13. A yarn feeding device comprising a motor housing having supported therein a rotatingly drivable hollow shaft which carries a winding element, a storage body which is rotatably supported on said hollow shaft and secured against rotation therewith, an extension arm which is secured to said motor housing and extends along said storage body, at least two yarn threading nozzles of which at least a first one is arranged in front of the yarn feed end of said hollow shaft and at least a second one is arranged on said extension arm, and a pneumatic valve device which is actuable by a source of pressure and is used for selectively actuating the at least one first threading nozzle or all of said threading nozzles, said pneumatic valve device comprising a housing and first and second valve openers that are manually actuable for opening valves via actuating connections, wherein flow channels are provided which are separated from each other, said flow channels leading to said at least one first threading nozzle and to said at least one second threading nozzle, said flow channels being provided in said housing of said valve device, said second valve opener and said valve which is actuable by means of said first valve opener having a unilaterally operative drag coupling arranged therebetween for transmitting the actuating movement of said second valve opener also to said valve which is normally actuable by means of said first valve opener.

14. The yarn feeding device according to claim 13, wherein said extension arm includes an annular brake body which cooperates with said storage body, said annular brake body being adjustable relative to said storage body between a brake position and a gap position by means of a pneumatic piston-cylinder unit which is arranged in said extension arm, and wherein said piston-cylinder unit can be pressurized in parallel with said at least one second threading nozzle and, upon pressurization of all of said threading valves, by means of said second valve opener via said valve device.

15. The yarn feeding device according to claim 13, wherein said valve device comprises a plastic valve housing which is inserted into a cutout of said motor housing with said first and second valve openers being exposed and said valve housing being approximately flush with the rear side of said motor housing.

16. The yarn feeding device according to claim 15, wherein a compressed-air connection is connected by an elastic connection tube to a supply connection of said valve housing of said valve means and is arranged in said motor housing.

17. The yarn feeding device according to claim 15, wherein locking tongues are provided which grip behind locking noses in the cutout of said motor housing and which removably hold said valve device, said locking tongues being integrally formed onto the plastic valve housing of said valve device.

* * * * *